US010837136B2

(12) United States Patent
Rineer et al.

(10) Patent No.: US 10,837,136 B2
(45) Date of Patent: Nov. 17, 2020

(54) TRANSPORT BOLT ASSEMBLY FOR A LAUNDRY APPLIANCE

(71) Applicant: WHIRLPOOL CORPORATION, Benton Harbor, MI (US)

(72) Inventors: Regan E. Rineer, St. Joseph, MI (US); David Michael Pawletki, Itasca, IL (US)

(73) Assignee: Whirlpool Corporation, Benton Harbor, MI (US)

( * ) Notice: Subject to any disclaimer, the term of this patent is extended or adjusted under 35 U.S.C. 154(b) by 120 days.

(21) Appl. No.: 16/230,934

(22) Filed: Dec. 21, 2018

(65) Prior Publication Data

US 2020/0199802 A1 Jun. 25, 2020

(51) Int. Cl.
*D06F 39/00* (2020.01)
*B65D 85/68* (2006.01)

(52) U.S. Cl.
CPC ..... *D06F 39/001* (2013.01); *B65D 85/68* (2013.01); *B65D 2585/6855* (2013.01)

(58) Field of Classification Search
CPC ..... D06F 39/001
See application file for complete search history.

(56) References Cited

U.S. PATENT DOCUMENTS

| | | | |
|---|---|---|---|
| 3,184,048 | A | 5/1965 | Bjerum |
| 3,249,215 | A | 5/1966 | Kelly |
| 4,624,117 | A | 11/1986 | Ory et al. |

FOREIGN PATENT DOCUMENTS

| | | | |
|---|---|---|---|
| DE | 6918574 | U | 9/1969 |
| DE | 3739036 | A1 | 5/1989 |
| DE | 9206506 | U1 | 9/1993 |
| DE | 4215780 | C2 | 9/1996 |
| DE | 29820224 | U1 | 4/2000 |
| DE | 102007009511 | A1 | 8/2008 |
| EP | 0916760 | A2 | 5/1999 |
| EP | 2132367 | B1 | 1/2011 |
| EP | 2657390 | B1 | 12/2014 |
| FR | 2278827 | B1 | 12/1976 |
| KR | 100316994 | B1 | 12/2001 |
| KR | 20020042993 | A | 6/2002 |
| KR | 20040046970 | A | 6/2004 |
| KR | 20060007264 | A | 1/2006 |
| KR | 20060032321 | A | 4/2006 |
| WO | 2005066408 | A1 | 7/2005 |
| WO | 2005066409 | A1 | 7/2005 |
| WO | 2007039594 | A1 | 4/2007 |

*Primary Examiner* — Jason Y Ko
(74) *Attorney, Agent, or Firm* — Price Heneveld LLP

(57) ABSTRACT

A transport bolt assembly to immobilize a tub of a laundry appliance comprising: a bolt including a head disposed at a first end, a second end configured to insert into a bolt receiver of a tub of a laundry appliance, and a length between the first end and the second end; and a washer comprising a body, a hole through the body, through which the length of the bolt is disposed, with a first side of the body facing towards the head of the bolt and a second side of the body facing towards the second end of the bolt, and an appendage extending away from the body of the washer at an obtuse angle transitioning to a reflex angle relative to the first side of the body of the washer.

20 Claims, 9 Drawing Sheets

TRANSPORT BOLT ASSEMBLY FOR A LAUNDRY APPLIANCE

BACKGROUND

The present device generally relates to a transport bolt assembly for a laundry appliance, and a laundry appliance utilizing a transport bolt assembly.

During transportation, shipping, and handling of a laundry appliance, the tub suspended in the interior of the cabinet can move around and hit internal surfaces and cause damage to the laundry appliance. To prevent the tub from moving around as such, one or more transport bolt assemblies are used to immobilize the tub during the transportation, shipping, and handling. However, these transport bolt assemblies are inadequate because the transport bolt assemblies do not preclude a user from plugging in a power cord of the laundry appliance and operating the laundry appliance while the transport bolt assemblies are still immobilizing the drum. Operating the laundry appliance while the transport bolt assemblies are still immobilizing the drum can damage the internal components of the laundry appliance and thus cause failure of the laundry appliance. More particularly, the transport bolt assemblies preclude the suspension features (e.g., springs and dampers) from working as intended. Instead of the suspension features absorbing vibration during operation of the laundry appliance, the vibrations are translated to the cabinet.

SUMMARY

Disclosed herein is a new transport bolt assembly that precludes the user from extending the power cord to insert the plug into an electrical outlet without first removing the transport bolt assembly from the drum and the cabinet generally. The new transport bolt assembly includes features that provide easy removal of the transport bolt assembly and retention of the components of the transport bolt assembly as a unit, to prevent loss of components.

In at least one aspect, a transport bolt assembly to immobilize a tub of a laundry appliance comprises: a bolt including a head disposed at a first end, a second end configured to insert into a bolt receiver of a tub of a laundry appliance, and a length between the first end and the second end; and a washer comprising a body, a hole through the body, through which the length of the bolt is disposed, with a first side of the body facing towards the head of the bolt and a second side of the body facing towards the second end of the bolt, and an appendage extending away from the body of the washer at an obtuse angle transitioning to a reflex angle relative to the first side of the body of the washer. In an embodiment, the length of the bolt has a first radius and a second radius that is larger than the first radius. In an embodiment, the second radius is disposed closer to the second end than the first radius. In an embodiment, the second end of the bolt is threaded. In an embodiment, the first side of the body of the washer abuts the head of the bolt. In an embodiment, the appendage extends away from the body of the washer at an obtuse angle transitioning to a portion parallel to the first side of the washer, then transitioning to the reflex angle that is orthogonal to the first side of the body of the washer, then terminating in an end. In an embodiment, the transport bolt assembly further comprises a hollow cylindrical bushing through which the length of the bolt extends such that the hollow cylindrical bushing is positioned between the first end of the bolt and the second end of the bolt. In an embodiment, the hollow cylindrical bushing includes: an inner surface having an inner radius that is larger than a first radius of the length of the bolt; a first portion having an outer radius; a second portion contiguous with the first portion and having an outer radius that is smaller than the outer radius of the first portion; and a lip extending from the first portion away from the second portion and at least partially enveloping the washer. In an embodiment, the first portion has a length, and the second portion has a length that is longer than the length of the first portion. In an embodiment, the transport bolt assembly further comprises a hollow cylindrical spacer through which the length of the bolt extends such that the hollow cylindrical spacer is positioned between the first end of the bolt and the second end of the bolt. In an embodiment, the hollow cylindrical spacer includes an inner surface having an inner radius that is larger than a first radius of the length of the bolt; and a projection extending from the inner surface, the projection having a minimum radius that is smaller than the second radius of the length of the bolt. In an embodiment, the washer is disposed between the head of the bolt and the hollow cylindrical spacer. In an embodiment, the minimum radius of the projection is smaller than the first radius of the length of the bolt such that the bolt compresses the projection. In an embodiment, the inner surface of the hollow cylindrical bushing surrounds the first portion of the outer surface of the hollow cylindrical spacer, and the projection extending from the first portion of the outer surface of the hollow cylindrical spacer compresses the inner surface of the hollow cylindrical bushing.

In at least another aspect, a laundry appliance comprises: a tub to retain water during a washing operation; a drum within the tub to receive an article of clothing for the washing operation, the tub including a bolt receiver; a cabinet at least partially enclosing the tub within an interior, the cabinet including a first aperture providing access to the bolt receiver, a second aperture adjacent the first aperture, and an exterior surface facing an exterior; a power cord terminating in a plug; and a transport bolt assembly extending into the first aperture of the cabinet, the transport bolt assembly including: a bolt including a head disposed at a first end, a second end inserted into the bolt receiver of the tub placing the bolt in a received position, and a length between the first end and the second end; and a washer comprising a body, a hole through the body, through which the length of the bolt is disposed, with a first side of the body facing towards the head of the bolt and away from the exterior surface of the cabinet, a second side facing towards the exterior surface of the cabinet, and an appendage extending away from the body of the washer at an obtuse angle transitioning to a reflex angle relative to the first side of the washer and into the second aperture of the cabinet; wherein, the appendage limits the ability of the power cord to move away from the exterior surface of the cabinet. In an embodiment, the second end of the bolt is threaded. In an embodiment, the second end is inserted into the bolt receiver of the tub to place the bolt in a received position by rotating the second end of the bolt while within the bolt receiver. In an embodiment, the appendage of the washer extends away from the body of the washer at an obtuse angle transitioning to a portion parallel to the first side of the washer, then transitioning to the reflex angle that is orthogonal to the first side of the washer, then terminating in an end. In an embodiment, the parallel portion is disposed at the exterior of the cabinet, and the end of the appendage is disposed in the interior of the cabinet. In an embodiment, the transport bolt assembly further includes a hollow cylindrical bushing through which the length of the bolt extends such that the hollow cylindrical bushing is positioned between the head of the bolt and the second end of the bolt. In an embodiment, the hollow cylindrical bushing includes: an inner surface having an inner radius that is larger than a first radius of the length of the bolt; a first portion disposed to the exterior of the cabinet and abutting the exterior surface of the cabinet, the first portion having an outer radius; a second portion extending through the first aperture of the cabinet and into the interior of the cabinet, the second portion being contiguous with the first portion and having an outer radius that is smaller than the outer radius of the first portion; and a lip extending from the first portion away from the second portion and at least partially enveloping the washer. In an embodiment, as the bolt is manipulated to the received position, the washer compresses the first portion of the hollow cylindrical bushing against the exterior surface of the cabinet. In an embodiment, the length of the bolt has a first radius and a second radius that is larger than the first radius, the second radius being disposed closer to the second end than the first radius. In an embodiment, the transport bolt assembly further includes a hollow cylindrical spacer, maintaining separation between the cabinet and the bolt receiver of the tub, through which the length of the bolt extends such that the hollow cylindrical spacer is positioned between the first end of the bolt and the second end of the bolt. In an embodiment, the hollow cylindrical spacer includes: an inner surface having an inner radius that is larger than the first radius of the length of the bolt; and a projection extending from the inner surface, the projection having a minimum radius that is smaller than the second radius of the bolt. In an embodiment, the washer is disposed between the head of the bolt and the hollow cylindrical spacer. In an embodiment, as the bolt is manipulated away from the received position, the projection of the hollow cylindrical spacer abuts the second end of the bolt and maintains the length of the bolt extending through the hollow cylindrical spacer. In an embodiment, the inner surface of the hollow cylindrical bushing surrounds the first portion of the outer surface of the hollow cylindrical spacer, and the projection extending from the first portion of the outer surface of the hollow cylindrical spacer compresses the inner surface of the hollow cylindrical bushing, such that, when a pulling force is applied to either the head of the bolt, the hollow cylindrical bushing, or the washer to manipulate the bolt away from the received position, the interaction between the projection extending from the first portion of the outer surface of the hollow cylindrical spacer and the inner surface of the hollow cylindrical bushing causes the hollow cylindrical spacer to move as well.

In at least another aspect, a transport bolt assembly to immobilize a tub of a laundry appliance comprises: a bolt including a head disposed at a first end, a second end configured to insert into a bolt receiver of a tub of a laundry appliance, and a length between the first end and the second end, the length having a first radius and a second radius that is larger than the first radius and disposed closer to the second end than the first radius; and a hollow cylindrical spacer through which the length of the bolt extends such that the hollow cylindrical spacer is positioned between the first end of the bolt and the second end of the bolt, the hollow cylindrical spacer including: an inner surface having an inner radius that is larger than a first radius of the length of the bolt; and a projection extending from the inner surface, the projection having a minimum radius that is smaller than the second radius of the length of the bolt. In an embodiment, the minimum radius of the projection is smaller than the first radius of the length of the bolt such that the bolt compresses the projection. In an embodiment, the transport bolt assembly further comprises a washer comprising a body, a hole through the body, through which the length of the bolt is disposed, with a first side of the body facing towards the head of the bolt and the second side of the body facing towards the second end of the bolt, and an appendage extending away from the body of the washer at an obtuse angle transitioning to a reflex angle relative to the first side of the body of the washer. In an embodiment, the hole through the body of the washer has a radius, and the radius of the hole of the washer and the inner radius of the hollow cylindrical spacer are both too small for the head of the bolt to fit through.

These and other features, advantages, and objects of the present device will be further understood and appreciated by those skilled in the art upon studying the following specification, claims, and appended drawings.

DETAILED DESCRIPTION OF EMBODIMENTS

Figure 1:
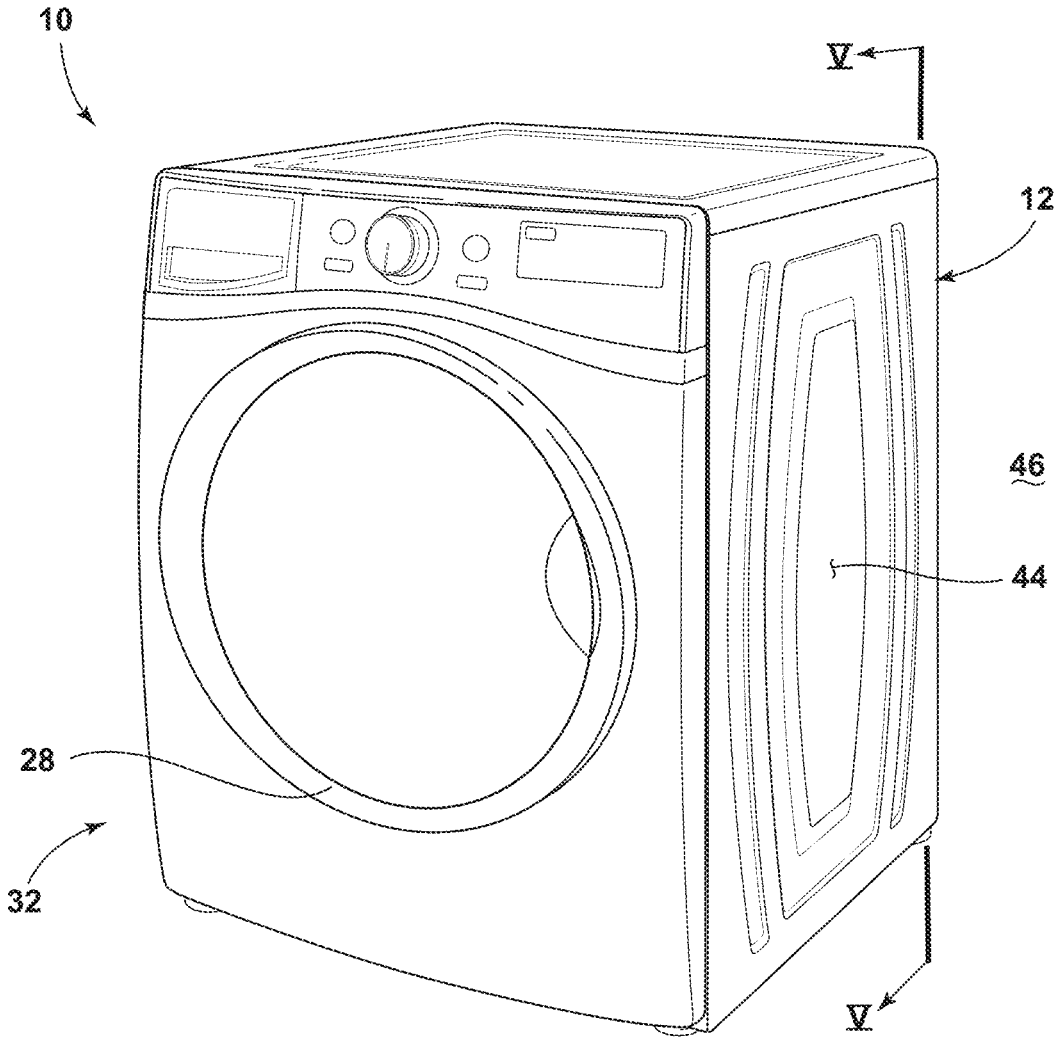
FIG. 1 is a perspective view of a laundry appliance, illustrating a cabinet having an exterior surface facing an exterior.
Figure 2:
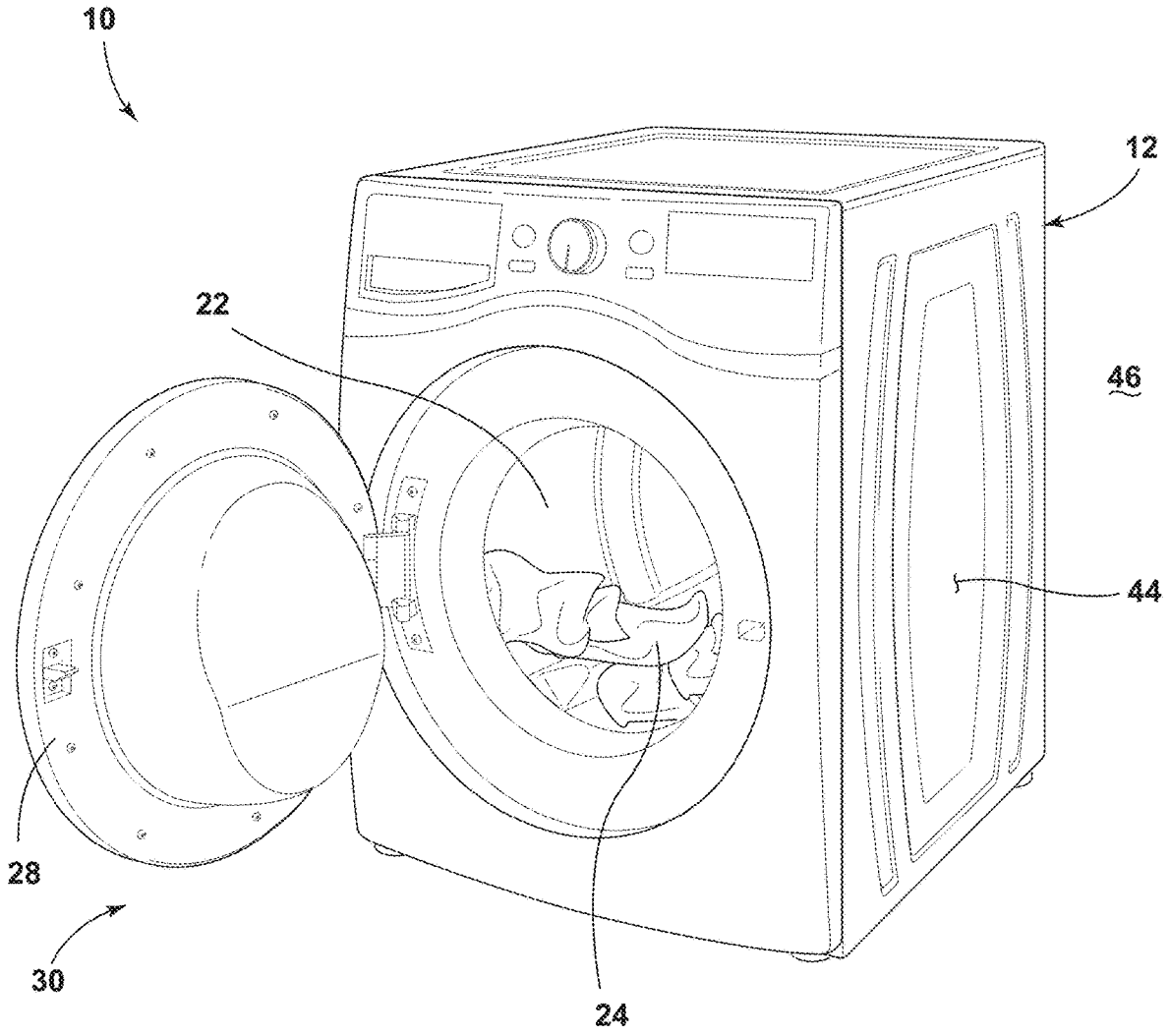
FIG. 2 is a front view of the laundry appliance of FIG. 1, illustrating a door attached to the cabinet in an open position allowing access into a drum, into which an article of clothing can be inserted for a laundering operation.
Figure 3:
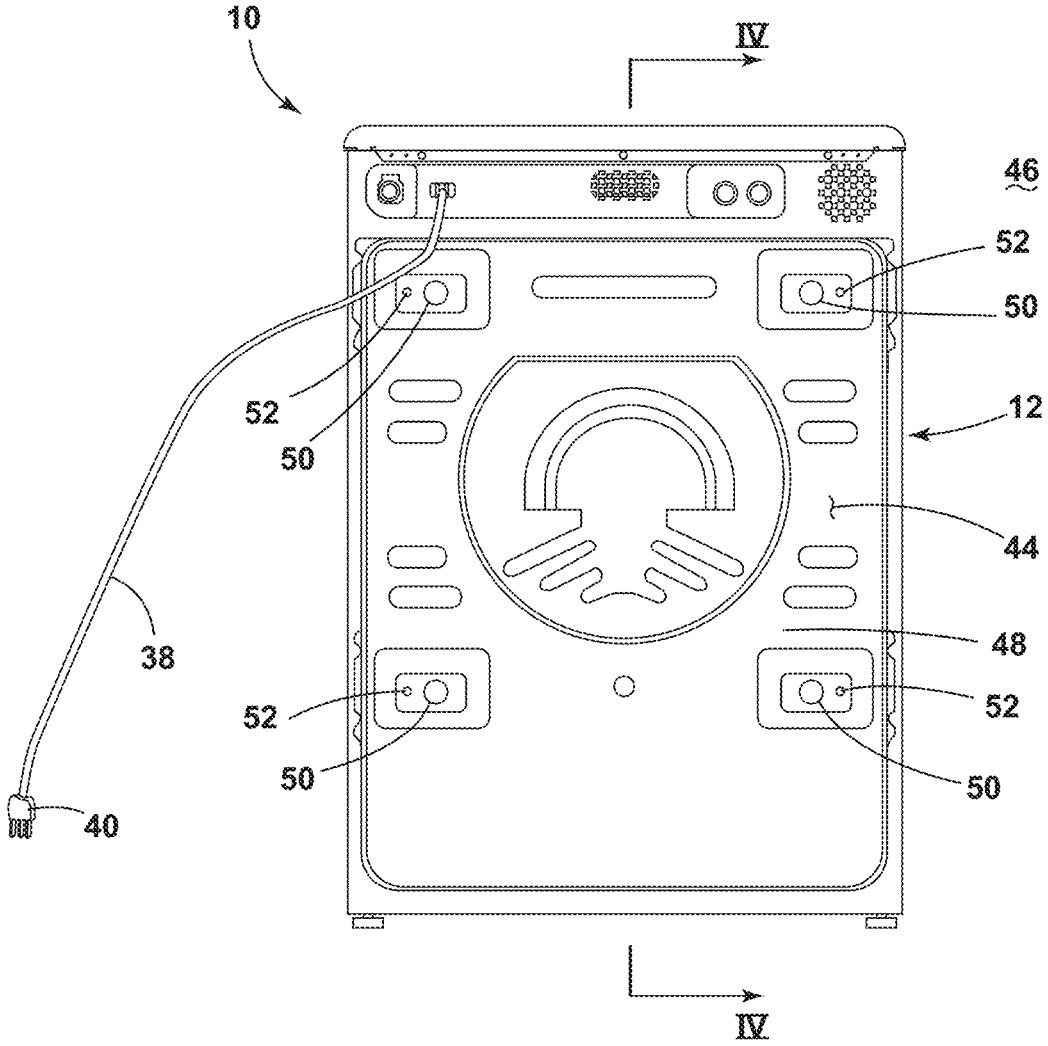
FIG. 3 is a rear view of the laundry appliance of FIG. 1, illustrating a rear portion of the cabinet, and a series of first apertures adjacent to second apertures, and a power cord terminating in a plug.
Figure 4:
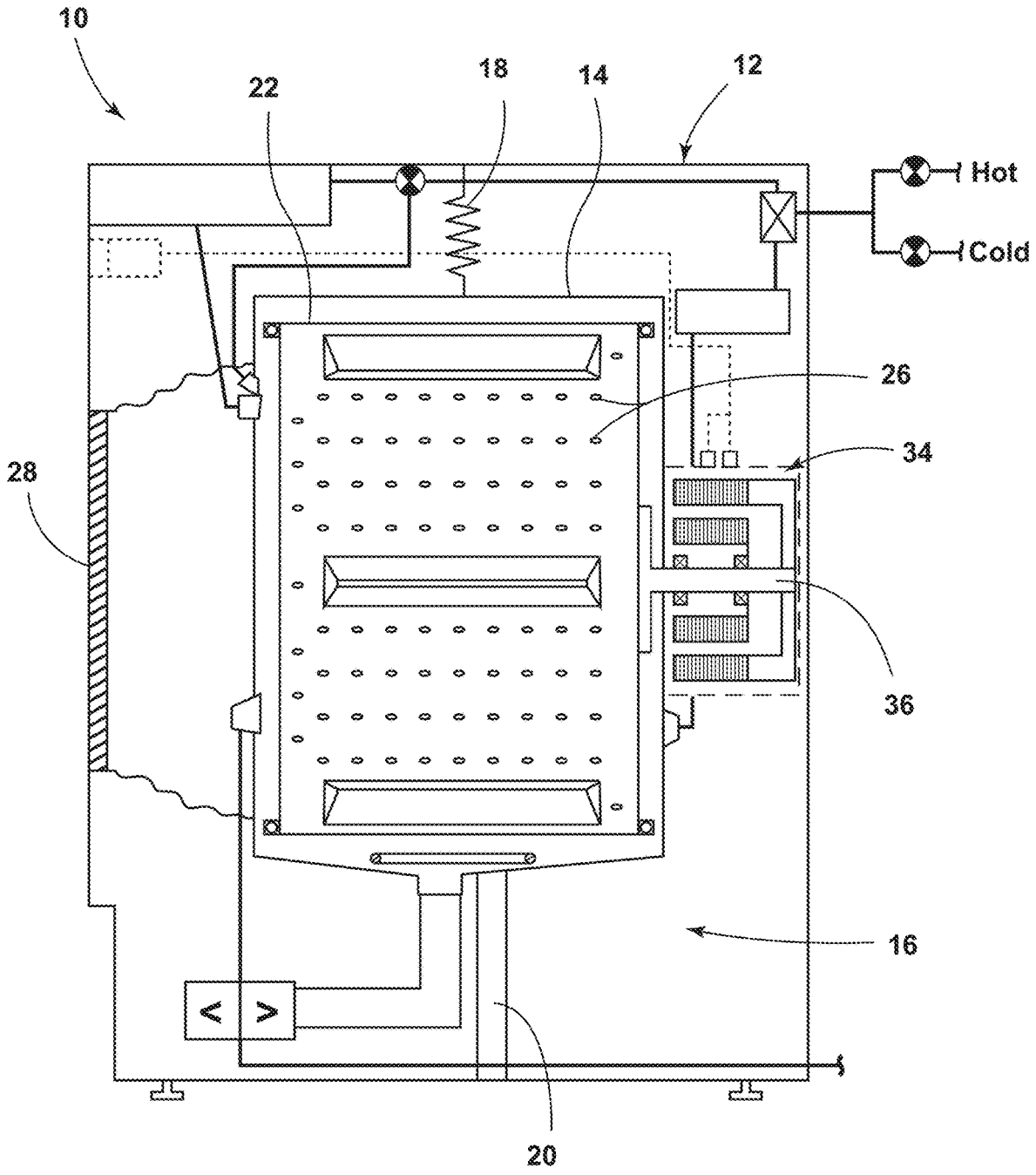
FIG. 4 is a view of the cross-section taken along line IV-IV of FIG. 3, illustrating a tub surrounding the drum with springs and dampers securing the drum to the cabinet.
Figure 5:
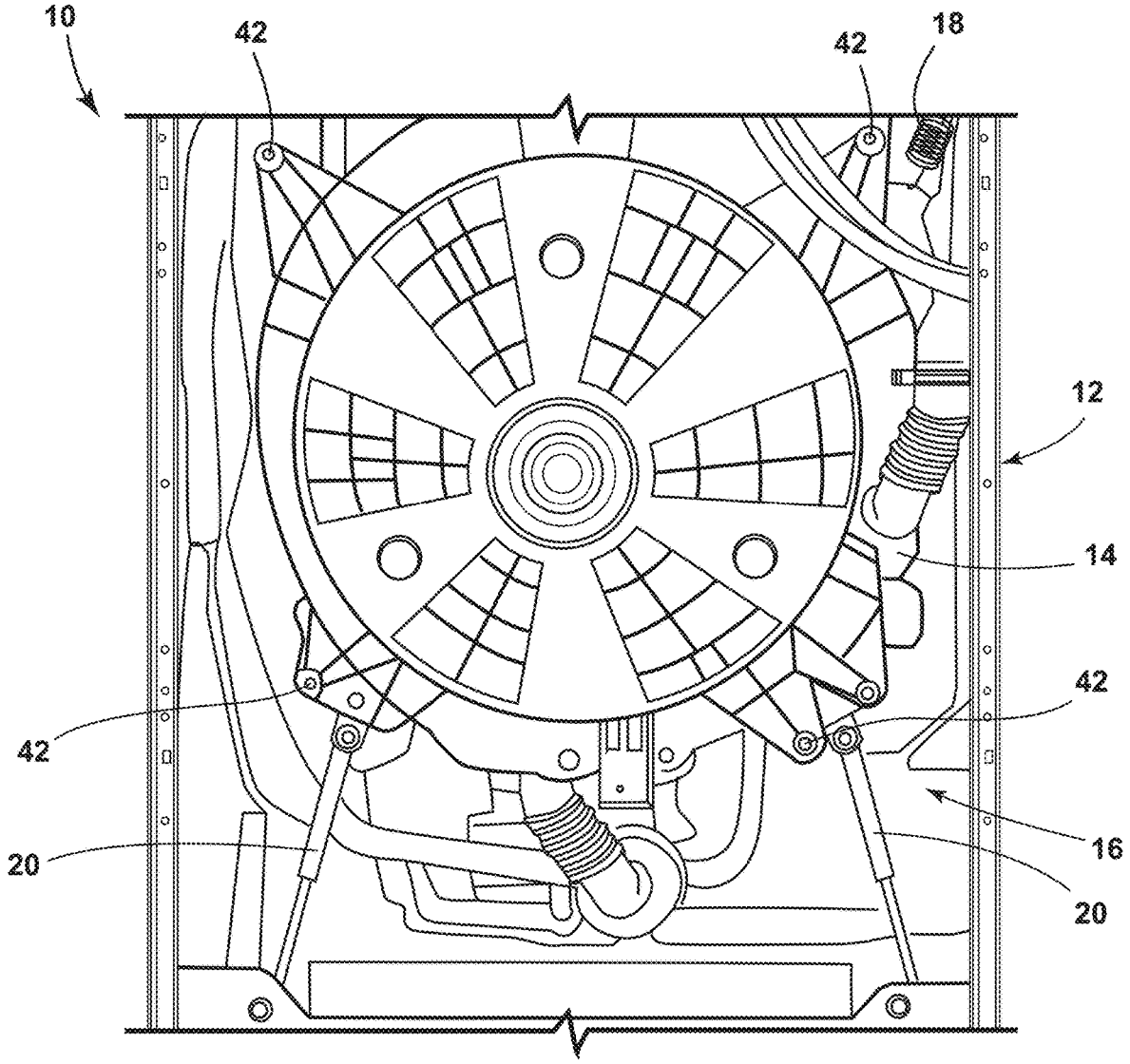
FIG. 5 is a view of the cross-section taken along line V-V of FIG. 1, illustrating the tub having bolt receivers that are accessible from the first apertures of the rear portion of the cabinet.

It is to be understood that the device may assume various alternative orientations and step sequences, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

Referring now to FIGS. 1-5, a laundry appliance 10 includes a cabinet 12 supporting and at least partially enclosing a tub 14 within an interior 16. The cabinet 12 can support the tub 14 with springs 18 and dampers 20. The laundry appliance 10 includes a drum 22 within the tub 14. The tub 14 retains water during a washing operation of an article of clothing 24, which is received in the drum 22 of the tub 14. The drum 22 can include perforations 26 allowing liquid to flow between the tub 14 and the drum 22 through the perforations 26. The laundry appliance 10 further includes a door 28 mounted to the cabinet 12. The door 28 can be manipulated to, from, and between an open position 30 and a closed position 32 to selectively allow or prevent access to the drum 22. The laundry appliance 10 further includes a motor 34 that rotates a drive shaft 36 connected to the drum 22 to rotate the drum 22 during the washing operation. In other embodiments, the motor 34 can cause the drum 22 to rotate via a belt, as known in the art. The laundry appliance 10 further includes a power cord 38 that terminates in a plug 40. The laundry appliance 10 can be a washing machine, a dryer, or a combination washing machine and dryer.

The tub 14 further includes one or more bolt receivers 42, the purpose of which is discussed further below. The cabinet 12 has an exterior surface 44 that faces an exterior 46 outside of the laundry appliance 10. The cabinet 12 includes a rear portion 48, located on the opposite side of the laundry appliance 10 as the door 28. For each of the one or more bolt receivers 42, the cabinet 12 includes a first aperture 50 providing access to the particular bolt receiver 42 and a second aperture 52 adjacent to the first aperture 50. The first aperture 50 and the second aperture 52 can be disposed through the rear portion 48 of the cabinet 12.

Figure 6:
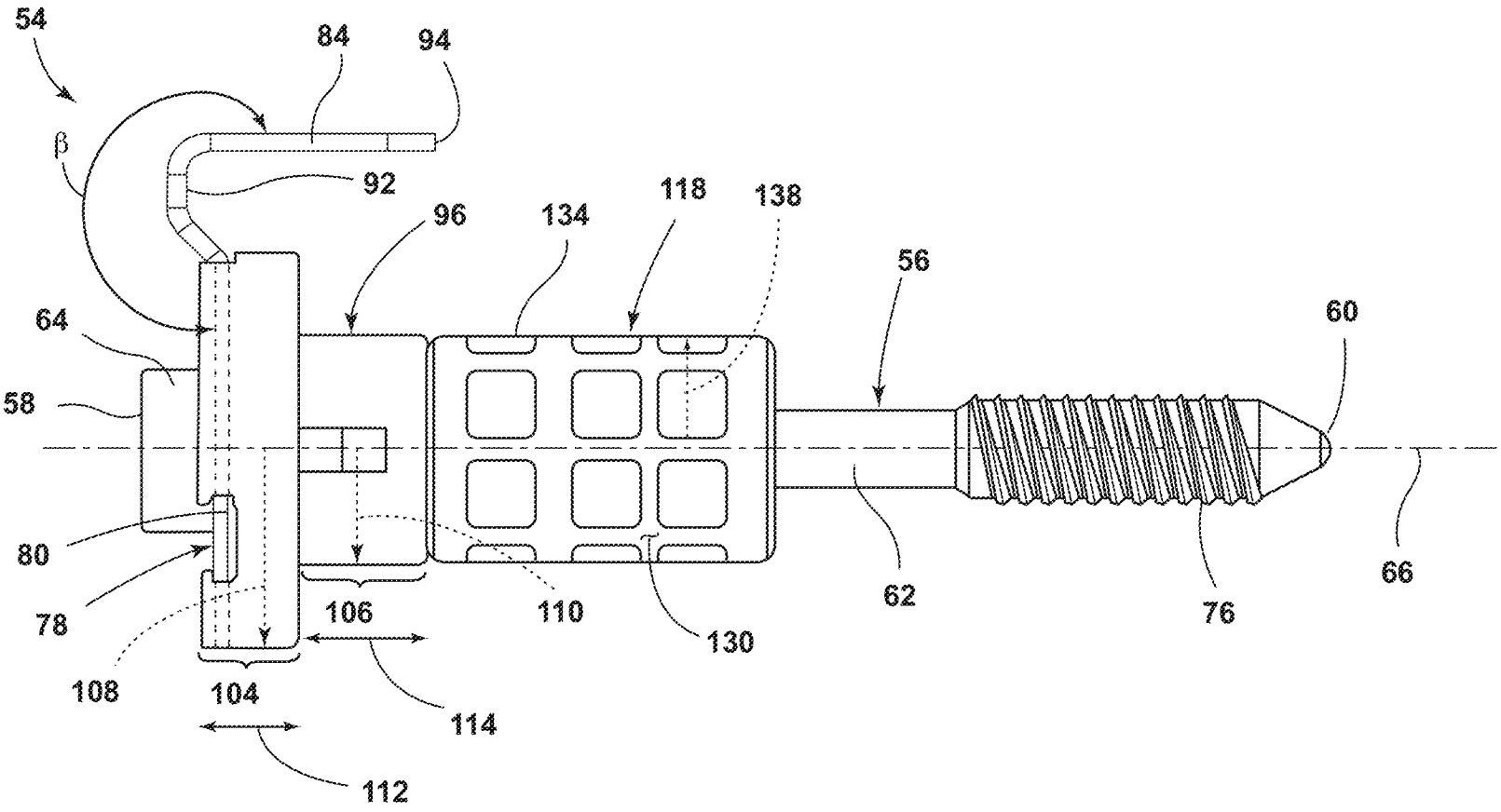
FIG. 6 is side view of a transport bolt assembly to insert into each of the bolt receivers of the drum through the series of first apertures through the rear portion of the cabinet of the laundry appliance of FIG. 1.
Figure 7:
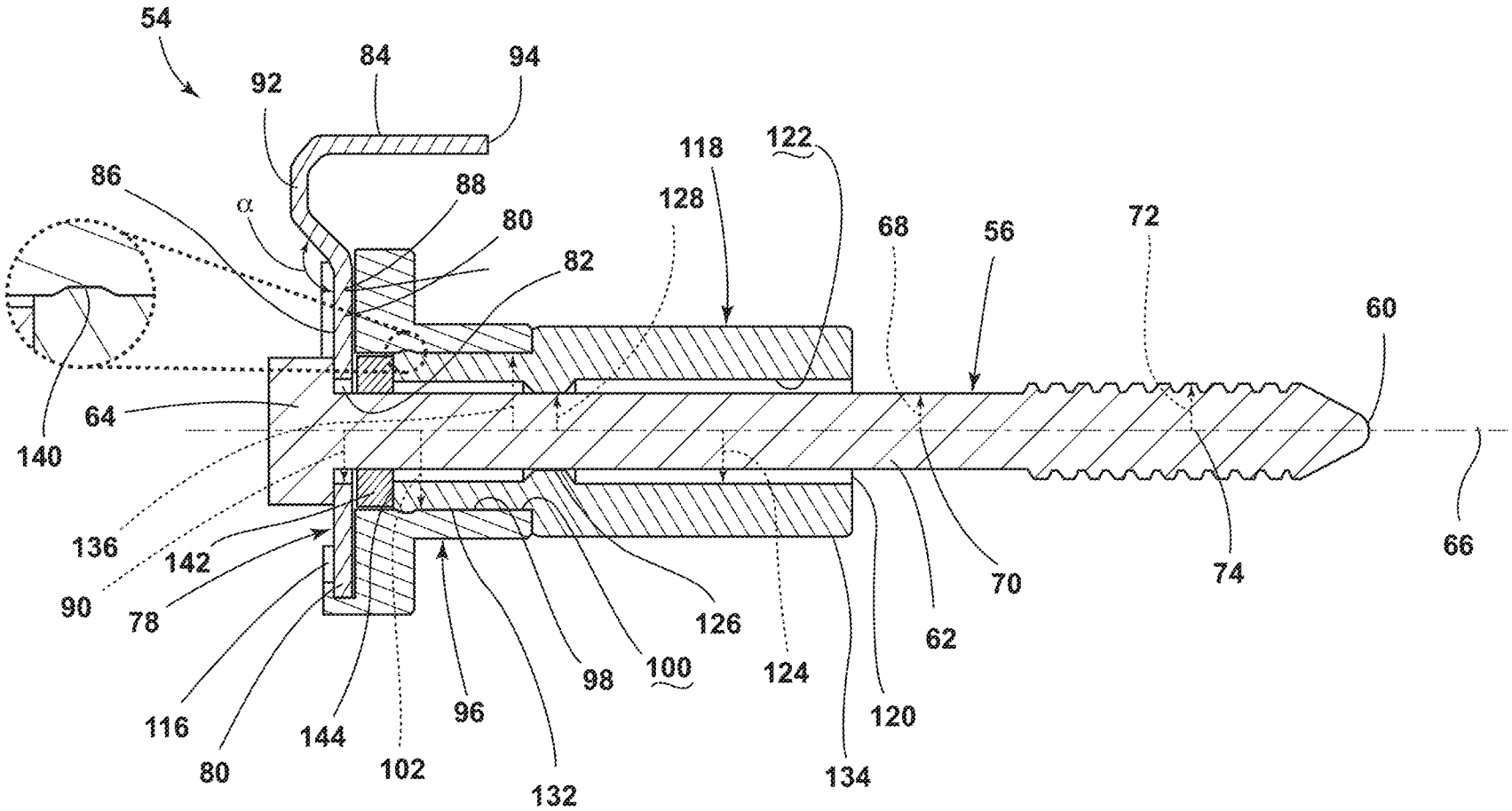
FIG. 7 is a cross-sectional view of the transport bolt assembly of FIG. 6, illustrating a bolt extending through a washer having an appendage, a hollow cylindrical bushing, and a hollow cylindrical spacer.

Referring now to FIGS. 6 and 7, a transport bolt assembly 54 to use with the laundry appliance 10 to immobilize the tub 14 during transportation of the laundry appliance 10 is now herein described. The transport bolt assembly 54 includes a bolt 56. The bolt 56 includes a first end 58, a second end 60, and a length 62 between the first end 58 and the second end 60. A head 64 of the bolt 56 is disposed at the first end 58. The bolt 56 can be symmetrical or approximately symmetrical about an axis 66 that runs through the first end 58 and the second end 60. The length 62 of the bolt 56 can be cylindrical and have a first radius 68 at one point 70 along the length 62 and a second radius 72 at another point 74 along the length 62. The second radius 72 is larger than the first radius 68. The second radius 72 is disposed closer to the second end 60 than the first radius 68. The purpose of the larger second radius 72 is discussed further below. Additionally as will be discussed further below, the second end 60 of the bolt 56 is configured to be inserted into the bolt receiver 42 of the tub 14 of the laundry appliance 10. For an example embodiment, the second end 60 of the bolt 56 is threaded 76 to match threads (not illustrated) of the bolt receiver 42 of the tub 14, to allow the bolt 56 to become coupled to the bolt receiver 42 in a rotational manner.

The transport bolt assembly 54 further includes a washer 78. The washer 78 includes a body 80, a hole 82 through the body 80, and an appendage 84 extending from the body 80. The length 62 of the bolt 56 is disposed through the body 80 of the washer 78. The body 80 of the washer 78 has a first side 86 and a second side 88. The first side 86 of the body 80 faces towards the head 64 of the bolt 56. In an embodiment, the first side 86 of the body 80 abuts the head 64 of the bolt 56. The hole 82 through the body 80 of the washer 78 has a radius 90, which is too small for the head 64 of the bolt 56 to fit through. The second side 88 of the body 80 faces towards the second end 60 of the bolt 56. The appendage 84 extends away from the body 80 of the washer 78 first at an obtuse angle $\alpha$, then later at a reflex angle $\beta$, relative to the first side 86 of the body 80 of the washer 78. In an embodiment, the appendage 84 extends away from the body 80 of the washer 78 first at the obtuse angle $\alpha$, then transitions to a portion 92 that is parallel to the first side 86 of the body 80 of the washer 78, then transitions at the reflex angle $\beta$, then terminates in an end 94 of the appendage 84. The reflex angle $\beta$ can be 180 degrees, that is, orthogonal to the first side 86 of the body 80 of the washer 78.

The transport bolt assembly 54 further includes a hollow cylindrical bushing 96. The length 62 of the bolt 56 extends through a central aperture 98 of the hollow cylindrical bushing 96. The hollow cylindrical bushing 96 is positioned between the first end 58 of the bolt 56 and the second end 60 of the bolt 56. The hollow cylindrical bushing 96 has an inner surface 100 with an inner radius 102. The inner radius 102 is larger than the first radius 68 and the second radius 72 of the bolt 56. In the illustrated embodiment, the hollow cylindrical bushing 96 is segmented into a first portion 104 and a second portion 106, differentiated by different outer radii 108, 110, respectively. However, the hollow cylindrical bushing 96 need not be segmented as described. The first portion 104 and the second portion 106 are contiguous. The outer radius 110 of the second portion 106 is smaller than the outer radius 108 of the first portion 104. Both the first portion 104 and the second portion 106 have a length 112, 114, respectively. In the illustrated embodiment, the length 114 of the second portion 106 is longer than the length 112 of the first portion 104. However, the lengths 112, 114 need not be that way.

The hollow cylindrical bushing 96 further includes a lip 116. The lip 116 extends from the first portion 104 directionally away from the second portion 106 and then back towards the axis 66 to at least partially envelope the washer 78. The lip 116 can include a cutout portion (not illustrated) to allow for the appendage 84 to extend away from the body 80 of the washer 78. The lip 116 thus retains the washer 78 to the hollow cylindrical bushing 96. The hollow cylindrical bushing 96 can be made of rubber or any other typically used material for bushings.

The transport bolt assembly 54 further comprises a hollow cylindrical spacer 118. The length 62 of the bolt 56 extends through a central aperture 120 of the hollow cylindrical spacer 118, such that the hollow cylindrical spacer 118 is positioned between the first end 58 of the bolt 56 and the second end 60 of the bolt 56. The hollow cylindrical spacer 118 includes an inner surface 122 defining the central aperture 120. The inner surface 122 has an inner radius 124. The inner radius 124 is larger than the first radius 68 of the length 62 of the bolt 56 but too small for the head 64 of the bolt 56 to fit through. In an embodiment, the inner radius 124 is just slightly larger than the second radius 72 of the length 62 of the bolt 56. The hollow cylindrical spacer 118 further includes a projection 126 that extends from the inner surface 122. The projection 126 has a minimum radius 128. The minimum radius 128 is smaller than the second radius 72 of the length 62 of the bolt 56, and in the illustrated embodiment, smaller than the first radius 68 of the length 62 of the bolt 56. The larger first radius 68 of the length 62 of the bolt 56 compresses the smaller minimum radius 128 of the projection 126. The hollow cylindrical spacer 118 further includes an outer surface 130. The outer surface 130 has a first portion 132 and a second portion 134. The first portion 132 has an outer radius 136. The second portion 134 has an outer radius 138, which is greater than the outer radius 136 of the first portion 132. A projection 140 extends from the outer surface 130 at the first portion 132. The inner surface 100 of the hollow cylindrical bushing 96 surrounds the first portion 132 of the outer surface 130 of the hollow cylindrical spacer 118. The projection 140 extending from the outer surface 130 compresses the inner surface 100 of the hollow cylindrical bushing 96, helping maintain the first portion 132 of the outer surface 130 of the hollow cylindrical spacer 118 with the hollow cylindrical bushing 96. The outer radius 110 of the second portion 106 of the hollow cylindrical bushing 96 can be approximately the same as (or the same as) the outer radius 138 of the second portion 134 of the hollow cylindrical spacer 118. The hollow cylindrical spacer 118 is made from a rigid material, such as a rigid plastic. The purpose of the hollow cylindrical spacer 118 is discussed further below.

In the illustrated embodiment, the transport bolt assembly 54 further includes an internal hollow cylindrical spacer 142. The internal hollow cylindrical spacer 142 is made of a compressible material such as rubber. The length 62 of the bolt 56 extends through the internal hollow cylindrical spacer 142. The internal hollow cylindrical spacer 142 is positioned between the second side 88 of the washer 78 and an end 144 of the hollow cylindrical spacer 118 at the first portion 132 thereof.

Figure 8:
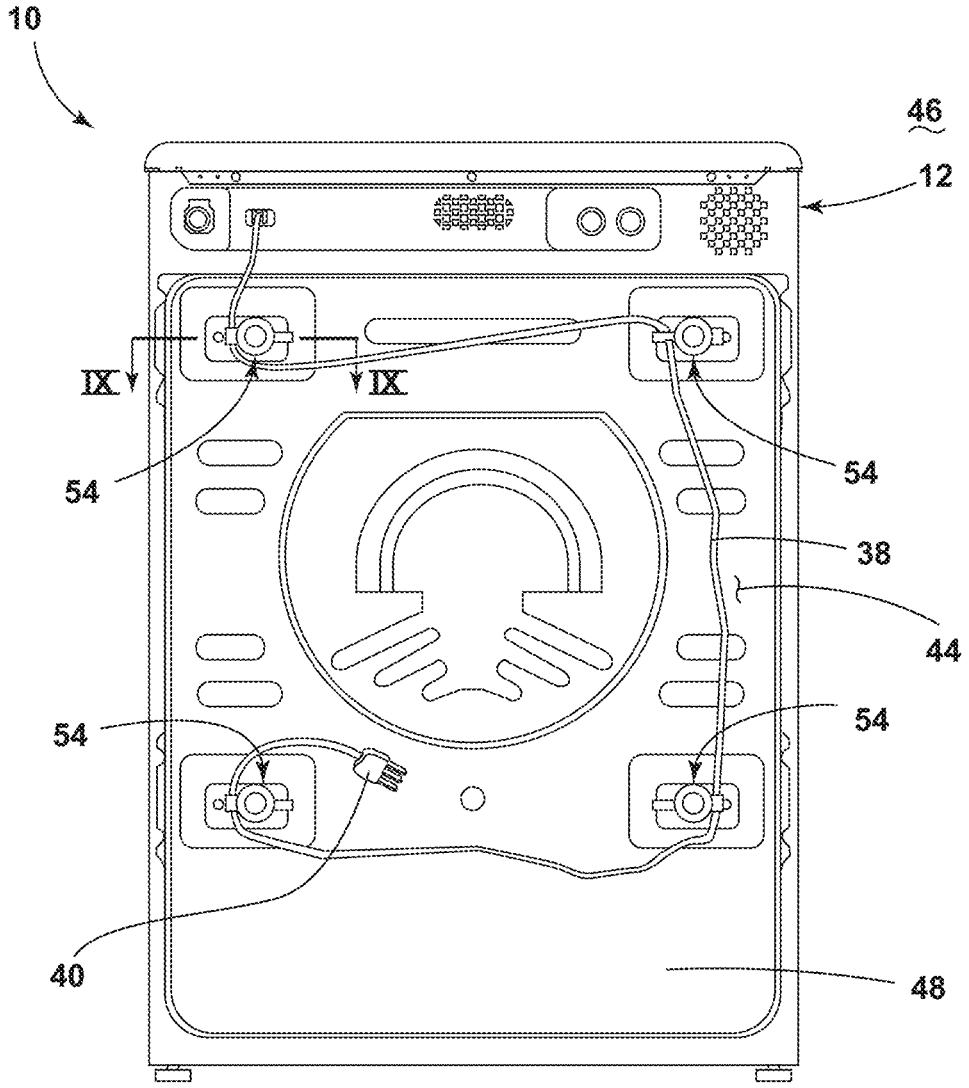
FIG. 8 is a rear view of the laundry appliance of FIG. 1 with the transport bolt assembly of FIG. 6 extending into each of the series of first apertures and second apertures to retain the power cord next to the rear portion of the cabinet, to prevent the plug of the power cord from being plugged into an electrical outlet until each of the transport bolt assemblies have been removed from the rear portion of the cabinet.
Figure 9:
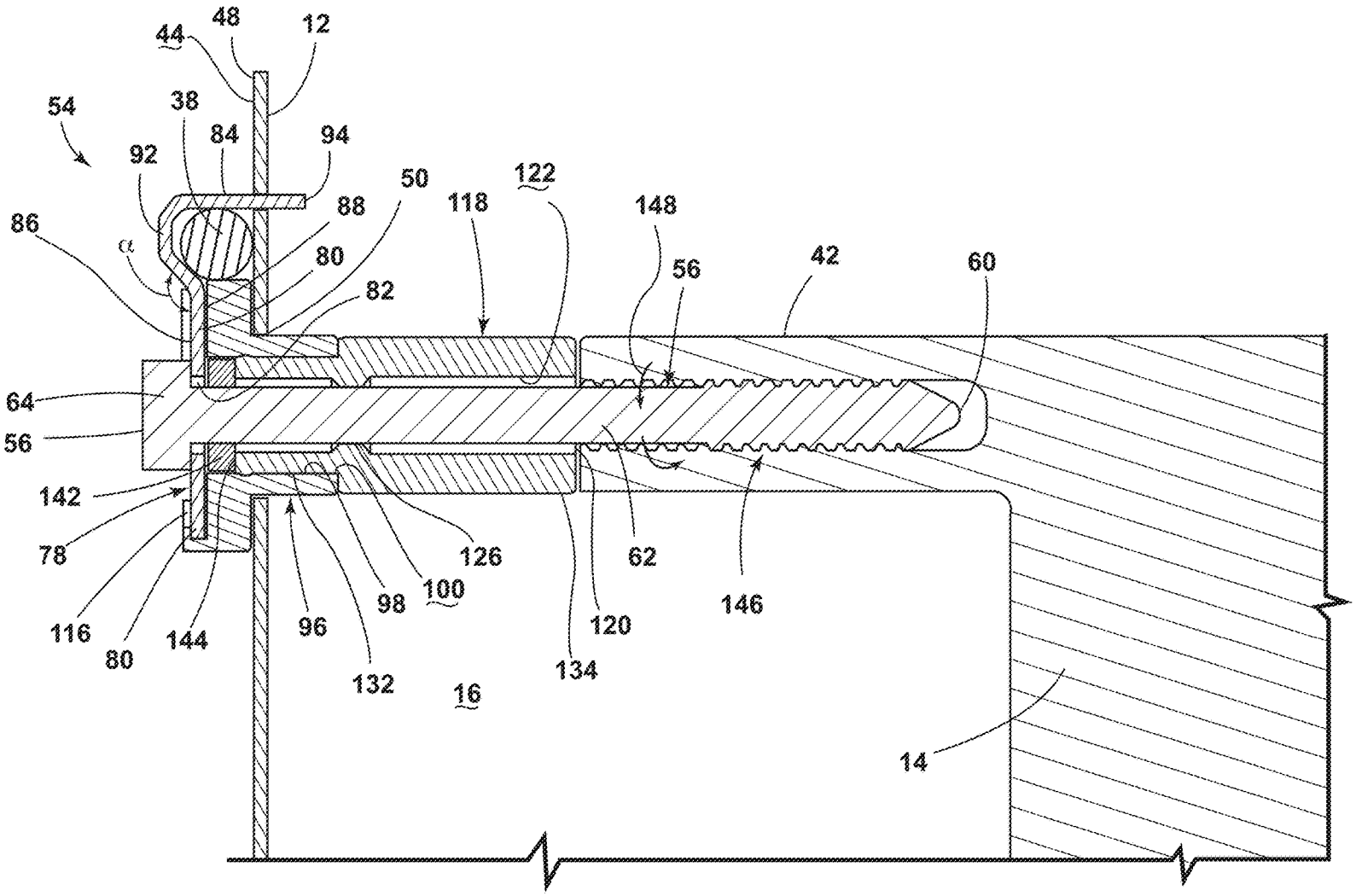
FIG. 9 is a side view of the cross-section taken along line IX-IX of FIG. 8, illustrating a bolt of the transport bolt assembly received in a receiving position within the bolt receiver of the drum, with the appendage of the washer extending through the second aperture of the rear portion of the cabinet and trapping the power cord between the appendage and the rear portion of the cabinet.

Referring now to FIGS. 8-9, the transport bolt assembly 54 is utilized to immobilize the tub 14 of the laundry appliance 10 during transport of the laundry appliance 10. The transport bolt assembly 54 extends into the first aperture 50 of the cabinet 12. The second end 60 of the bolt 56 is inserted in the bolt receiver 42 of the tub 14, which places the bolt 56 in a received position 146. In an embodiment, the bolt 56 has the threads 76 near the second end 60 of the bolt 56, and the second end 60 is inserted into the bolt receiver 42 of the tub 14 to place the bolt 56 in the received position 146 by rotating 148 the second end 60 of the bolt 56 while within the bolt receiver 42. The first portion 104 of the hollow cylindrical bushing 96 is disposed to the exterior 46 of the cabinet 12 and abuts the exterior surface 44 of the cabinet 12. The second portion 106 of the hollow cylindrical bushing 96 extends through the first aperture 50 of the cabinet 12 and the interior 16 of the cabinet 12. The first side 86 of the body 80 of the washer 78 faces towards the head 64 of the bolt 56 and away from the exterior surface 44 of the cabinet 12. The second side 88 of the washer 78 faces towards the exterior surface 44 of the cabinet 12. The appendage 84 of the washer 78 extends into the second aperture 52 of the cabinet 12. The end 94 of the appendage 84 is disposed within the interior 16 of the laundry appliance 10. The body 80 of the washer 78 is disposed at the exterior 46. The parallel portion 92 of the appendage 84 can be parallel to the exterior surface 44 of the rear portion 48 and disposed at the exterior 46. In an embodiment, as the bolt 56 is manipulated to the received position 146, the washer 78 compresses the first portion 104 of the hollow cylindrical bushing 96 against the exterior surface 44 of the cabinet 12. The second portion 134 of the outer surface 130 of the hollow cylindrical spacer 118 is disposed within the interior 16 of the cabinet 12.

The power cord 38 is trapped between the exterior surface 44 of the rear portion 48 of the cabinet 12 and the appendage 84 of the washer 78. So trapping the power cord 38 limits the ability of the power cord 38 to move away from the exterior surface 44 of the cabinet 12. In some embodiments, the appendage 84 compresses the power cord 38 against the exterior surface 44 of the rear portion 48 of the cabinet 12. Thus, the appendage 84 prevents the plug 40 of the power cord 38 from being plugged into an electrical outlet (not illustrated). A user (not illustrated) will thus be prevented from powering and operating the laundry appliance 10 with the transport bolt assembly 54 still coupled to the bolt receiver 42 of the tub 14, which, as explained, would potentially damage the tub 14, the rear portion 48, and other components within the interior 16 of the cabinet 12. To place the plug 40 of the power cord 38 into an outlet to power the laundry appliance 10, the user must first withdraw the transport bolt assembly 54 from the bolt receiver 42, in which case the user would likely remove the transport bolt assembly 54 entirely from the first aperture 50 of the cabinet 12. To ensure that all transport bolt assemblies 54 are withdrawn from their respective bolt receivers 42 of the tub 14, each of the transport bolt assemblies 54 utilized can place the power cord 38 between the appendage 84 of the transport bolt assembly 54 and the rear portion 48. In another embodiment, only a portion of the power cord 38 proximate the plug 40 of the power cord 38 is trapped between the appendage 84 and the rear portion 48.

The hollow cylindrical spacer 118 maintains separation between the rear portion 48 of the cabinet 12 and the bolt receiver 42 of the tub 14. When the laundry appliance 10 is being transported, the rear portion 48 could be inadvertently forced inward to the interior 16, which could deform the rear portion 48 and damage the tub 14 or other components in the interior 16. The hollow cylindrical spacer 118 helps prevent such deformation and damage.

In the event that the transport bolt assembly 54 is removed from the received position 146 and withdrawn from the cabinet 12, the lip 116 of the hollow cylindrical bushing 96 that at least partially envelopes the washer 78 keeps the washer 78 attached to the hollow cylindrical bushing 96, to prevent the washer 78 from separating and possibly becoming lost. The projection 126 extending from the inner surface 122 of the hollow cylindrical spacer 118, having the minimum radius 128 that is smaller than the second radius 72 of the bolt 56, prevents the bolt 56 from being withdrawn from the hollow cylindrical spacer 118. Similarly, as the bolt 56 is manipulated away from the received position 146 (such as the head 64 being pulled away from the exterior surface 44), the cabinet 12 could trap, by friction, the hollow cylindrical bushing 96 within the first aperture 50 of the rear portion 48. However, as the bolt 56 is manipulated away from the received position 146, the second end 60 of the bolt 56 abuts the projection 126 of the hollow cylindrical spacer 118 and maintains the length 62 of the bolt 56 extending through the hollow cylindrical spacer 118. Thus, additional pulling force on the bolt 56 will overcome the friction between the first aperture 50 of the rear portion 48 and the hollow cylindrical bushing 96, allowing the entire transport bolt assembly 54 to be withdrawn from the rear portion 48. The projection 140 extending from the first portion 132 of the outer surface 130 of the hollow cylindrical spacer 118 (compressing the inner surface 100 of the hollow cylindrical bushing 96 that surrounds the first portion 132 of the outer surface 130 of the hollow cylindrical spacer 118) further maintains the transport bolt assembly 54 together as a unit as the transport bolt assembly 54 is being withdrawn from the first aperture 50 of the rear portion 48 and thereafter. When a pulling force is applied to either the head 64 of the bolt 56, the hollow cylindrical bushing 96, or the washer 78 to manipulate the bolt 56 away from the received position 146 within the bolt receiver 42 of the tub 14, the interaction between the projection 140 extending from the first portion 132 of the outer surface 130 of the hollow cylindrical spacer 118 and the inner surface 100 of the hollow cylindrical bushing 96 causes the hollow cylindrical spacer 118 to move as well. The projection 140 extending from the first portion 132 of the outer surface 130 of the hollow cylindrical spacer 118 helps keep the hollow cylindrical spacer 118 and the hollow cylindrical bushing 96 coupled together. The lip 116 of the hollow cylindrical bushing 96 at least partially enveloping the washer 78 helps keep the washer 78 and the hollow cylindrical bushing 96 together. The projection 126 extending from the inner surface 122 of the hollow cylindrical spacer 118 helps keep the hollow cylindrical spacer 118 and the bolt 56 together. All of those disparate features help keep the transport bolt assembly 54 together as a unit when not in the received position 146 and while the transport bolt assembly 54 is being withdrawn from the first aperture 50 of the cabinet 12.

It will be understood by one having ordinary skill in the art that construction of the described device and other components is not limited to any specific material. Other exemplary embodiments of the device disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the device as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connectors or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present device. The exemplary structures and processes disclosed herein are for illustrative purposes and are not to be construed as limiting.

It is also to be understood that variations and modifications can be made on the aforementioned structures and methods without departing from the concepts of the present device, and further it is to be understood that such concepts are intended to be covered by the following claims unless these claims by their language expressly state otherwise.

The above description is considered that of the illustrated embodiments only. Modifications of the device will occur to those skilled in the art and to those who make or use the device. Therefore, it is understood that the embodiments shown in the drawings and described above are merely for illustrative purposes and not intended to limit the scope of the device, which is defined by the following claims as interpreted according to the principles of patent law, including the Doctrine of Equivalents.

What is claimed is:

1. A transport bolt assembly to immobilize a tub of a laundry appliance comprising:

a bolt including a head disposed at a first end, a second end configured to insert into a bolt receiver of a tub of a laundry appliance, and a length between the first end and the second end; and a washer comprising (i) a body, (ii) a hole through the body, through which the length of the bolt is disposed, with a first side of the body facing towards the head of the bolt and a second side of the body facing towards the second end of the bolt, and (iii) an appendage extending away from the body of the washer at an obtuse angle transitioning to a reflex angle relative to the first side of the body of the washer.

2. The transport bolt assembly of claim 1, wherein, the length of the bolt has a first radius and a second radius that is larger than the first radius; and wherein, the second radius is disposed closer to the second end of the bolt than the first radius.

3. The transport bolt assembly of claim 1, wherein, the second end of the bolt is threaded.

4. The transport bolt assembly of claim 1, wherein, the first side of the body of the washer abuts the head of the bolt.

5. The transport bolt assembly of claim 1, wherein, the appendage transitions to a portion that is parallel to the first side of the washer after extending away from the body of the washer at the obtuse angle, and then transitions at the reflex angle to extend orthogonally to the first side of the body of the washer to terminate in an end.

6. The transport bolt assembly of claim 1 further comprising:

a hollow cylindrical bushing through which the length of the bolt extends such that the hollow cylindrical bushing is positioned between the first end of the bolt and the second end of the bolt, the hollow cylindrical bushing including:

an inner surface having an inner radius that is larger than a first radius of the length of the bolt;

a first portion having an outer radius;

a second portion contiguous with the first portion and having an outer radius that is smaller than the outer radius of the first portion; and a lip extending from the first portion away from the second portion and at least partially enveloping the washer.

7. The transport bolt assembly of claim 6, wherein, the first portion has a length; and wherein, the second portion has a length that is longer than the length of the first portion.

8. The transport bolt assembly of claim 2 further comprising:

a hollow cylindrical spacer through which the length of the bolt extends such that the hollow cylindrical spacer is positioned between the first end of the bolt and the second end of the bolt, the hollow cylindrical spacer including:

an inner surface having an inner radius that is larger than a first radius of the length of the bolt; and a projection extending from the inner surface, the projection having a minimum radius that is smaller than the second radius of the length of the bolt;

wherein, the washer is disposed between the head of the bolt and the hollow cylindrical spacer.

9. The transport bolt assembly of claim 8, wherein, the minimum radius of the projection is smaller than the first radius of the length of the bolt such that the bolt compresses the projection.

10. The transport bolt assembly of claim 8 further comprising:

a hollow cylindrical bushing through which the length of the bolt extends such that the hollow cylindrical bushing is positioned between the first end of the bolt and the second end of the bolt, the hollow cylindrical bushing including:

an inner surface having an inner radius that is larger than the first radius of the length of the bolt;

a first portion having an outer radius;

a second portion contiguous with the first portion and having an outer radius that is smaller than the outer radius of the first portion; and a lip extending from the first portion away from the second portion and at least partially enveloping the washer; and the hollow cylindrical spacer further including:

an outer surface having a first portion and a second portion, the first portion having an outer radius and the second portion having an outer radius that is greater than the outer radius of the first portion; and a projection extending from the outer surface at the first portion;

wherein, the inner surface of the hollow cylindrical bushing surrounds the first portion of the outer surface of the hollow cylindrical spacer, and the projection extending from the first portion of the outer surface of the hollow cylindrical spacer compresses the inner surface of the hollow cylindrical bushing.

11. A laundry appliance comprising:

a tub to retain water during a washing operation;

a drum within the tub to receive an article of clothing for the washing operation, the tub including a bolt receiver;

a cabinet at least partially enclosing the tub within an interior, the cabinet including a first aperture providing access to the bolt receiver, a second aperture adjacent the first aperture, and an exterior surface facing an exterior;

a power cord terminating in a plug; and a transport bolt assembly extending into the first aperture of the cabinet, the transport bolt assembly including:

a bolt including a head disposed at a first end, a second end inserted into the bolt receiver of the tub placing the bolt in a received position, and a length between the first end and the second end; and a washer comprising (i) a body, (ii) a hole through the body, through which the length of the bolt is disposed, with a first side of the body facing towards the head of the bolt and away from the exterior surface of the cabinet, and a second side of the body facing towards the exterior surface of the cabinet, and (iii) an appendage extending away from the body of the washer at an obtuse angle transitioning to a reflex angle relative to the first side of the washer and into the second aperture of the cabinet;

wherein, the appendage limits the ability of the power cord to move away from the exterior surface of the cabinet.

12. The laundry appliance of claim 11, wherein, the second end of the bolt is threaded; and wherein, the second end is inserted into the bolt receiver of the tub to place the bolt in the received position by rotating the second end of the bolt while within the bolt receiver.

13. The laundry appliance of claim 11, wherein, the appendage transitions to a portion that is parallel to the first side of the washer after extending away from the body of the washer at the obtuse angle, and then transitions at the reflex angle to extend orthogonally to the first side of the body of the washer to terminate in an end;

wherein, the portion of the appendage that is parallel to the first side of the washer is disposed at the exterior of the cabinet, and the end of the appendage is disposed in the interior of the cabinet.

14. The laundry appliance of claim 11, the transport bolt assembly further including:

a hollow cylindrical bushing through which the length of the bolt extends such that the hollow cylindrical bushing is positioned between the head of the bolt and the second end of the bolt, the hollow cylindrical bushing including:

an inner surface having an inner radius that is larger than a first radius of the length of the bolt;

a first portion disposed to the exterior of the cabinet and abutting the exterior surface of the cabinet, the first portion having an outer radius;

a second portion extending through the first aperture of the cabinet and into the interior of the cabinet, the second portion being contiguous with the first portion and having an outer radius that is smaller than the outer radius of the first portion; and a lip extending from the first portion away from the second portion and at least partially enveloping the washer;

wherein, as the bolt is manipulated to the received position, the washer compresses the first portion of the hollow cylindrical bushing against the exterior surface of the cabinet.

15. The laundry appliance of claim 11, the length of the bolt has a first radius and a second radius that is larger than the first radius, the second radius being disposed closer to the second end than the first radius;

the transport bolt assembly further including:

a hollow cylindrical spacer, maintaining separation between the cabinet and the bolt receiver of the tub, through which the length of the bolt extends such that the hollow cylindrical spacer is positioned between the first end of the bolt and the second end of the bolt, the hollow cylindrical spacer including:

an inner surface having an inner radius that is larger than the first radius of the length of the bolt; and a projection extending from the inner surface, the projection having a minimum radius that is smaller than the second radius of the bolt;

wherein, the washer is disposed between the head of the bolt and the hollow cylindrical spacer; and wherein, as the bolt is manipulated away from the received position, the projection of the hollow cylindrical spacer abuts the second end of the bolt and maintains the length of the bolt extending through the hollow cylindrical spacer.

16. The laundry appliance of claim 15, the transport bolt assembly further including:

a hollow cylindrical bushing through which the length of the bolt extends such that the hollow cylindrical bushing is positioned between the first end of the bolt and the second end of the bolt, the hollow cylindrical bushing including:

an inner surface having an inner radius that is larger than a first radius of the length of the bolt;

a first portion disposed at the exterior of the cabinet and abutting the exterior surface of the cabinet, the first portion having an outer radius;

a second portion extending through the first aperture of the cabinet and into the interior of the cabinet, the second portion being contiguous with the first portion and having an outer radius that is smaller than the outer radius of the first portion; and a lip extending from the first portion away from the second portion and at least partially enveloping the washer; and the hollow cylindrical spacer further including:

an outer surface having a first portion and a second portion, the first portion having an outer radius and the second portion having an outer radius that is greater than the outer radius of the first portion, the second portion disposed within the interior of the cabinet; and a projection extending from the outer surface at the first portion;

wherein, the inner surface of the hollow cylindrical bushing surrounds the first portion of the outer surface of the hollow cylindrical spacer, and the projection extending from the first portion of the outer surface of the hollow cylindrical spacer compresses the inner surface of the hollow cylindrical bushing, such that, when a pulling force is applied to either the head of the bolt, the hollow cylindrical bushing, or the washer to manipulate the bolt away from the received position, the interaction between the projection extending from the first portion of the outer surface of the hollow cylindrical spacer and the inner surface of the hollow cylindrical bushing causes the hollow cylindrical spacer to move as well.

17. A transport bolt assembly to immobilize a tub of a laundry appliance comprising:

a bolt including a head disposed at a first end, a second end configured to insert into a bolt receiver of a tub of a laundry appliance, and a length between the first end and the second end, the length having a first radius and a second radius that is larger than the first radius and disposed closer to the second end than the first radius; and a hollow cylindrical spacer through which the length of the bolt extends such that the hollow cylindrical spacer is positioned between the first end of the bolt and the second end of the bolt, the hollow cylindrical spacer including:

an inner surface having an inner radius that is larger than the first radius of the length of the bolt; and a projection extending from the inner surface, the projection having a minimum radius that is smaller than the second radius of the length of the bolt, and the minimum radius is smaller than the first radius of the length of the bolt such that the bolt compresses the projection.

18. The transport bolt assembly of claim 17 further comprising:

a hollow cylindrical bushing through which the length of the bolt extends such that the hollow cylindrical bushing is positioned between the first end of the bolt and the second end of the bolt, the hollow cylindrical bushing including:

an inner surface having an inner radius that is larger than the first radius of the length of the bolt;

a first portion having an outer radius; and a second portion contiguous with the first portion and having an outer radius that is smaller than the outer radius of the first portion;

wherein, the hollow cylindrical spacer further includes:

an outer surface having a first portion and a second portion, the first portion having an outer radius and the second portion having an outer radius that is greater than the outer radius of the first portion; and a projection extending from the outer surface at the first portion;

wherein, the inner surface of the hollow cylindrical bushing surrounds the first portion of the outer surface of the hollow cylindrical spacer, and the projection extending from the first portion of the outer surface of the hollow cylindrical spacer compresses the inner surface of the hollow cylindrical bushing.

19. The transport bolt assembly of claim 17 further comprising:

a washer comprising (i) a body, (ii) a hole through the body, through which the length of the bolt is disposed, with a first side of the body facing towards the head of the bolt and the second side of the body facing towards the second end of the bolt, and (iii) an appendage extending away from the body of the washer at an obtuse angle transitioning to a reflex angle relative to the first side of the body of the washer.

20. The transport bolt assembly of claim 19, wherein, the hole through the body of the washer has a radius; and wherein, the radius of the hole of the washer and the inner radius of the hollow cylindrical spacer are both too small for the head of the bolt to fit through.

* * * * *